US007319199B1

(12) United States Patent
Tuniewicz et al.

(10) Patent No.: US 7,319,199 B1
(45) Date of Patent: Jan. 15, 2008

(54) FUSIBLE ELECTRIC SLIDE SWITCH

(76) Inventors: Robert M. Tuniewicz, 14 Remsen Ct., Mt. Sinai, NY (US) 11766; Gilbert D. Talamo, P.O. Box 434, Great River, NY (US) 11739; Edwin Unser, 90 Leigh St., Williston Park, NY (US) 11596

( * ) Notice: Subject to any disclaimer, the term of this patent is extended or adjusted under 35 U.S.C. 154(b) by 395 days.

(21) Appl. No.: 10/822,082

(22) Filed: Apr. 9, 2004

Related U.S. Application Data

(60) Provisional application No. 60/461,184, filed on Apr. 9, 2003.

(51) Int. Cl.
*H01H 33/46* (2006.01)
*H01H 9/00* (2006.01)
*H01H 9/22* (2006.01)

(52) U.S. Cl. ..... 200/50.07

(58) Field of Classification Search ..... 200/50.01, 200/50.02, 50.07, 333
See application file for complete search history.

(56) References Cited

U.S. PATENT DOCUMENTS

| | | | | |
|---|---|---|---|---|
| 3,274,356 | A * | 9/1966 | Godfrey | 337/189 |
| 3,633,075 | A * | 1/1972 | Hawkins | 361/616 |
| 4,926,110 | A * | 5/1990 | Yoon | 323/345 |
| 6,205,017 | B1 * | 3/2001 | Wilkie et al. | 361/605 |
| 6,459,353 | B1 * | 10/2002 | Mattlar et al. | 337/9 |
| 6,560,123 | B1 * | 5/2003 | de Varennes et al. | 361/807 |

* cited by examiner

*Primary Examiner*—Elvin Enad
*Assistant Examiner*—Lheiren Mae A. Anglo
(74) *Attorney, Agent, or Firm*—Richard L. Miller

(57) ABSTRACT

A fusible electric slide switch. A fuse carrier is slidably mounted to a base, and has a pair of recesses holding fuses. A cover captures the fuse carrier between itself and the base, and has a pair of through slots aligning with the pair of recesses when the fuse carrier is in the off position so as to allow access to the fuses, and not aligning with, so as to allow the cover to conceal, the pair of recesses when the fuse carrier is in the on position so as to prevent contact with electrical components by a user. The cover further has spring contacts aligning with the pair of recesses when the fuse carrier is in the on position so as to apply a force to maintain the fuses in the pair of recesses.

18 Claims, 4 Drawing Sheets

22
18
27
34
20
36
40
38
68
66
47
14
33
32
26
28
30
24
25
12
5

16
70
72
72
9
9
76
74
76
14
42

16

70
76

FUSIBLE ELECTRIC SLIDE SWITCH

CROSS REFERENCE TO RELATED APPLICATIONS

The instant application is a nonprovisional application of U.S. provisional application No. 60/461,184, filed on Apr. 9, 2003, and entitled FUSIBLE ELECTRIC SLIDE SWITCH, and it is respectfully requested that this application be accorded the benefit under 35 USC 119(e) of said U.S. provisional application.

BACKGROUND OF THE INVENTION

1. Field of the Invention

The present invention relates to an electric slide switch, more particularly, the present invention relates to a fusible electric slide switch.

2. Description of the Prior Art

Numerous innovations for electric slide switches have been provided in the prior art that will be described. Even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a fusible electric slide switch that avoids the disadvantages of the prior art.

ANOTHER OBJECT of the present invention is to provide a fusible electric slide switch that is simple to use.

BRIEFLY STATED, STILL ANOTHER OBJECT of the present invention is to provide a fusible electric slide switch. A fuse carrier is slidably mounted to a base, and has a pair of recesses holding fuses. A cover captures the fuse carrier between itself and the base, and has a pair of through slots aligning with the pair of recesses when the fuse carrier is in the off position so as to allow access to the fuses, and not aligning with, so as to allow the cover to conceal, the pair of recesses when the fuse carrier is in the on position so as to prevent contact with electrical components by a user. The cover further has spring contacts aligning with the pair of recesses when the fuse carrier is in the on position so as to apply a force to maintain the fuses in the pair of recesses.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 3:
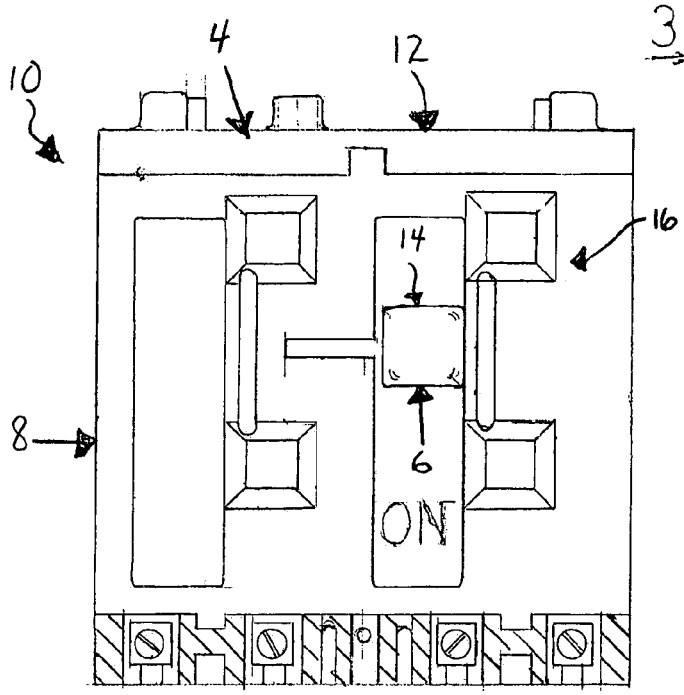
FIG. 3 is diagrammatic front elevational view taken generally in the direction of ARROW 3 in FIG. 2 of the present invention in the on position.

| | |
|---|---|
| 10 | fusible electric slide switch of present invention |
| 12 | base |
| 14 | fuse carrier |
| 16 | cover |
| 18 | back portion of base 12 |
| 20 | top portion of base 12 |
| 22 | uppermost edge of back portion 18 of base 12 |
| 24 | forwardmost surface of back portion 18 of base 12 |
| 25 | lowermost edge of back portion 18 of base 12 |
| 26 | plurality of electrical terminals of base 12 |
| 27 | lowermost surface of top portion 20 of base 12 |
| 28 | plurality of electrical lands of base 12 |
| 30 | plurality of electrodes of plurality of electrical lands 28 of base 12 |
| 32 | pair of plates of base 12 |
| 33 | blind bore in one plate of pair of plates 32 of base 12 |
| 34 | plunger assembly of base 12 |
| 36 | blind bore in lowermost surface 27 of top portion 20 of base 12 of plunger assembly 34 of base 12 |
| 38 | plunger of plunger assembly 34 of base 12 |
| 40 | spring of plunger assembly 34 of base 12 |
| 42 | forwardmost surface of fuse carrier 14 |
| 44 | rearwardmost surface of fuse carrier 14 |
| 46 | pair of sidewardmost surfaces of fuse carrier 14 |
| 47 | uppermost surface of fuse carrier 14 |
| 48 | pair of recesses in forwardmost surface 42 of fuse carrier 14 for holding pair of fuses (not shown), respectively |
| 50 | two pair of electrodes of fuse carrier 14 |
| 52 | tails of two pair of electrodes 50 of fuse carrier 14 |
| 54 | handle of fuse carrier 14 |
| 56 | pair of jumper electrodes of fuse carrier 14 |
| 58 | plunger assembly of fuse carrier 14 |
| 60 | blind bore in rearwardmost surface 44 of fuse carrier 14 of plunger assembly 58 of fuse carrier 14 |
| 62 | plunger of plunger assembly 58 of fuse carrier 14 |
| 64 | spring of plunger assembly 58 of fuse carrier 14 |
| 65 | stop assembly of fuse carrier 14 |
| 66 | blind slot in uppermost surface 47 of fuse carrier 14 of stop assembly 65 of fuse carrier 14 |
| 68 | pawl of stop assembly 65 of fuse carrier 14 |
| 70 | rearwardmost surface of cover 16 |
| 72 | pair of through slots in cover 16 |
| 74 | secondary through slot in cover 16 |
| 76 | two pair of spring contacts of cover 16 for applying force to and maintain fuses (not shown) in pair of recesses 48 in forwardmost surface 42 of fuse carrier 14 |

DETAILED DESCRIPTION OF THE PREFERRED EMBODIMENT

Figure 2:
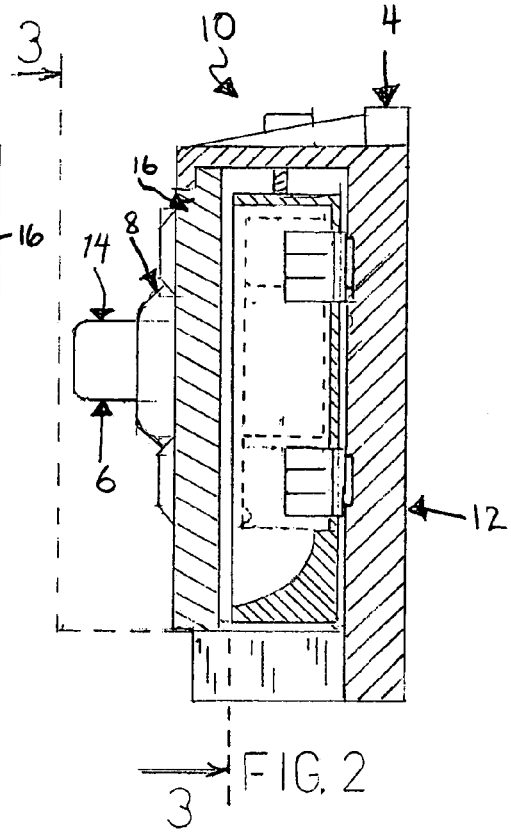
FIG. 2 is a diagrammatic cross sectional view taken along LINE 2-2 in FIG. 1.
Figure 1:
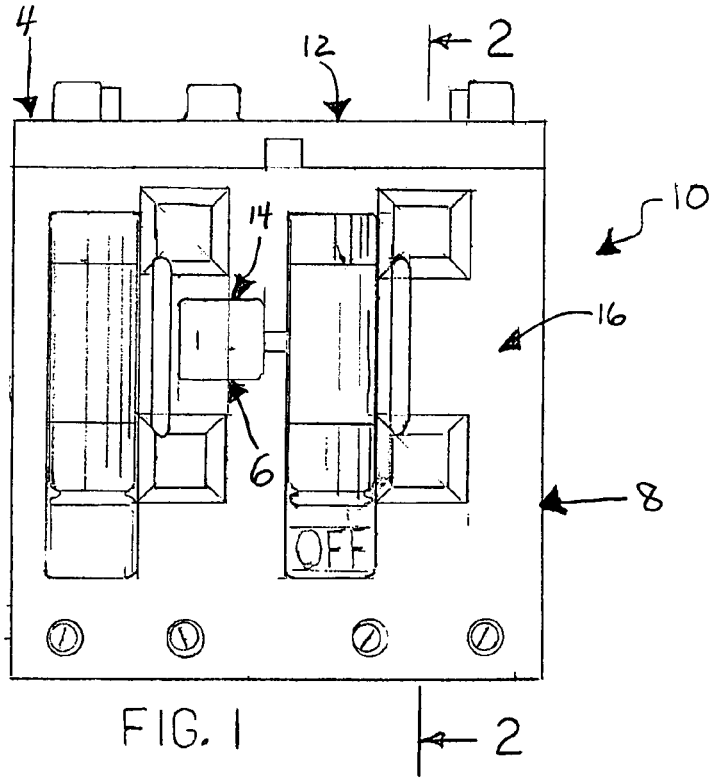
FIG. 1 is a diagrammatic front elevational view of the present invention in the off position.

Referring now to the figures, in which like numerals indicate like parts, and particularly to FIGS. 1-3, the fusible electric slide switch of the present invention is shown generally at 10.

The fusible electric slide switch 10 comprises a base 12, a fuse carrier 14, and a cover 16. The fuse carrier 14 is slidably mounted to the base 12, and the cover 16 maintains the fuse carrier 14 slidably mounted to the base 12.

Figures 4, 5:
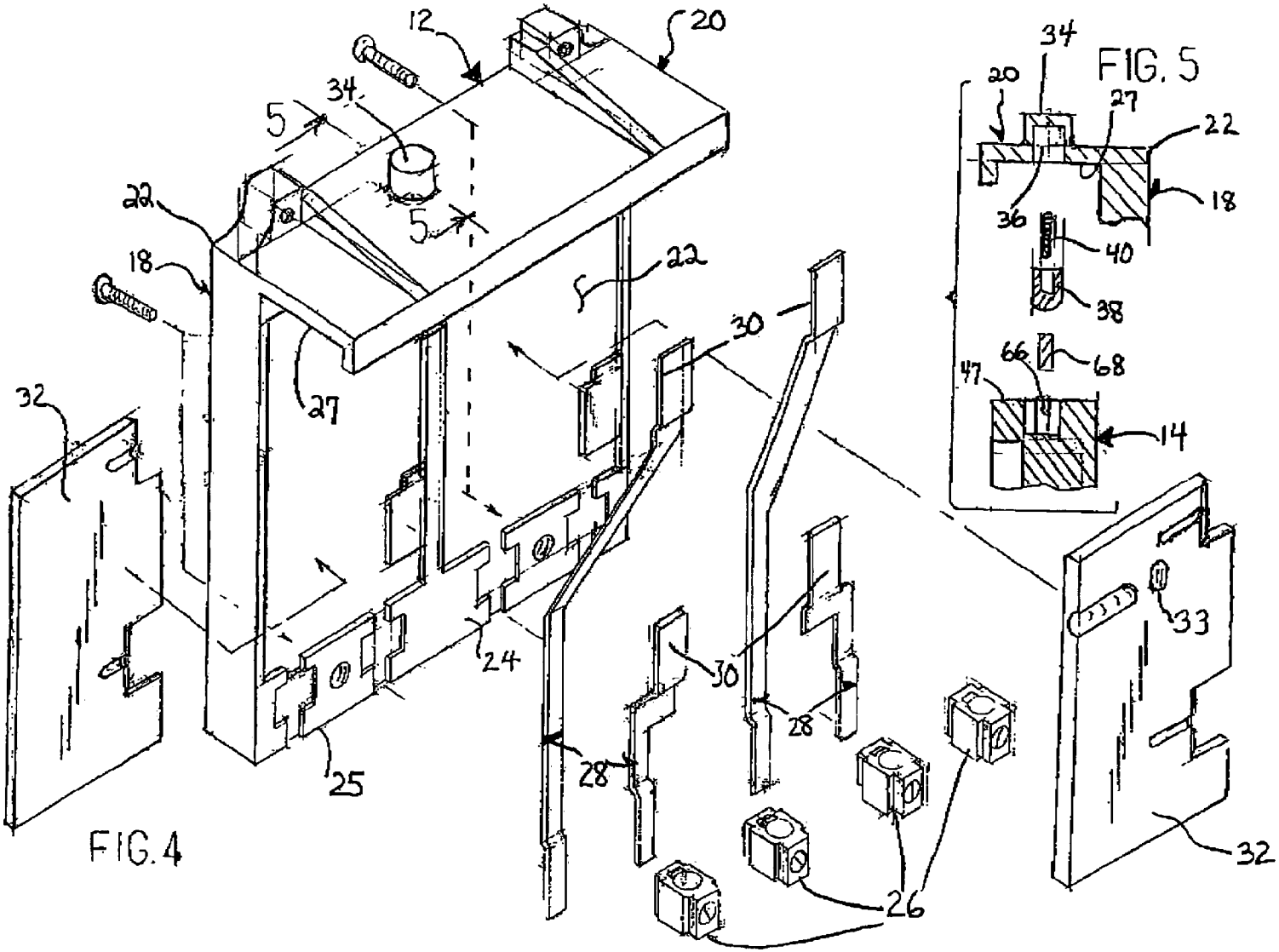
FIG. 4 is an exploded diagrammatic front perspective view of the base of the present invention identified by ARROW 4 in FIGS. 1-3.
FIG. 5 is an exploded diagrammatic cross sectional view taken along LINE 5-5 in FIG. 4.

The configuration of the base 12 can best be seen in FIGS. 4 and 5, and as such, will be discussed with reference thereto.

The base 12 has a back portion 18 and a top portion 20. The back portion 18 of the base 12 has an uppermost edge 22, a forwardmost surface 24, and a lowermost edge 25. The top portion 20 of the base 12 has a lowermost surface 27, and extends forwardly from the uppermost edge 22 of the back portion 18 of the base 12 so as to be generally inverted L-shaped in lateral cross section.

The base 12 further has a plurality of electrical terminals 26. The plurality of electrical terminals 26 of the base 12 are disposed on the forwardmost surface 24 of the back portion 18 of the base 12, adjacent the lowermost edge 25 of the back portion 18 of the base 12.

The base 12 further has a plurality of electrical lands 28. The plurality of electrical lands 28 of the base 12 have a plurality of electrodes 30, respectively, are disposed on the forwardmost surface 24 of the back portion 18 of the base 12, and electrically communicate with the plurality of electrical terminals 26 of the base 12, respectively.

The base 12 further has a pair of plates 32. The pair of plates 32 of the base 12 are disposed on the forwardmost surface 24 of the back portion 18 of the base 12 and cover the plurality of electrical lands 28 of the base 12, except for the plurality of electrodes 30 of the plurality of electrical lands 28 of the base 12.

One plate 32 of the base 12 has a blind bore 33.

The base 12 has a plunger assembly 34. The plunger assembly 34 of the base 12 comprises the lowermost surface 27 of the top portion 20 of the base 12 having a blind bore 36 and a plunger 38 disposed in the blind bore 36 in the lowermost surface 27 of the top portion 20 of the base 12 biased outwardly therefrom by a spring 40.

Figures 6, 7:
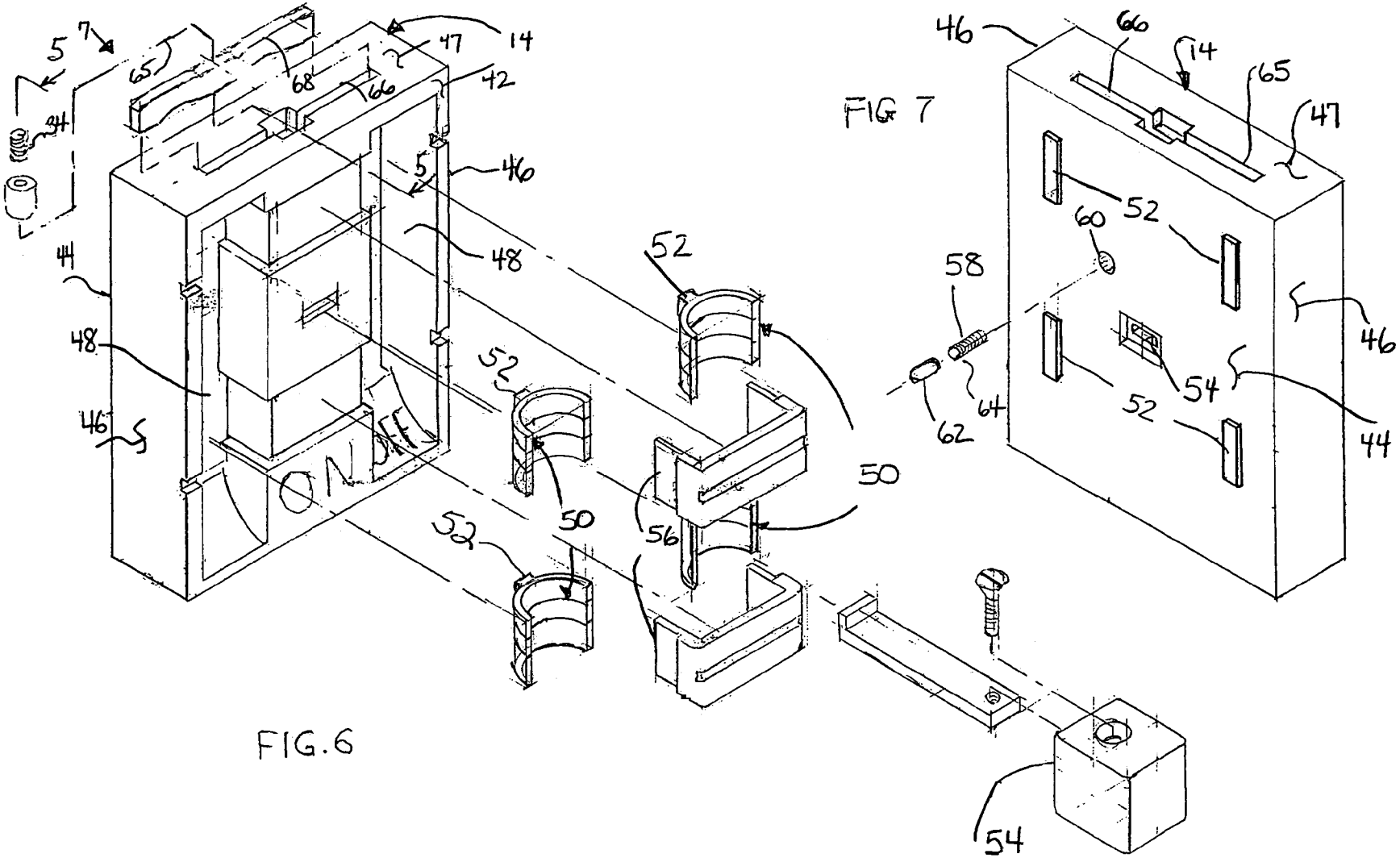
FIG. 6 is an exploded diagrammatic front perspective view of the fuse carrier of the present invention identified by ARROW 6 in FIGS. 1-3.
FIG. 7 is a diagrammatic rear perspective view taken generally in the direction of ARROW 7 in FIG. 6.

The configuration of the fuse carrier 14 can best be seen in FIGS. 5-7, and as such, will be discussed with reference thereto.

The fuse carrier 14 has a forwardmost surface 42, a rearwardmost surface 44, a pair of sidewardmost surfaces 46, and an uppermost surface 47. The rearwardmost surface 44 of the fuse carrier 14 abuts against the pair of plates 32 of the base 12 and the uppermost surface 47 of the fuse holder 14 abuts against the lowermost surface 27 of the top portion 20 of the base 12 as the fuse carrier 14 selectively slides sidewardly relative to the base 12.

The forwardmost surface 42 of the fuse carrier 14 has a pair of recesses 48 for holding a pair of fuses (not shown), respectively. The pair of recesses 48 in the forwardmost surface 42 of the fuse carrier 14 are disposed adjacent the pair of sidewardmost surfaces 46 of the fuse carrier 14, respectively.

The fuse carrier 14 further has two pair of electrodes 50 with tails 52. Each pair of electrodes 50 of the fuse carrier 14 are disposed in an associated recess 48 in the forwardmost surface 42 of the fuse carrier 14 for electrically communicating with an associated fuse (not shown) and have their tails 52 extend through the rearwardmost surface 44 of the fuse carrier 14 and selectively electrically communicate with the plurality of electrodes 30 of the base 12 as the fuse carrier 14 slides sidewardly relative to the base 12.

The fuse carrier 14 further has a handle 54. The handle 54 of the fuse carrier 14 extends generally centrally therethrough, from the forwardmost surface 42 of the fuse carrier 14 to the rearwardmost surface 44 of the fuse carrier 14, and moves therewith.

The fuse carrier 14 further has a pair of Jumper electrodes 56. The pair of jumper electrodes 56 of the fuse carrier 14 electrically connect associated ones of each pair of the two pair of electrodes 50 of the fuse carrier 14 with each other.

The fuse carrier 14 further has a plunger assembly 58. The plunger assembly 58 of the fuse carrier 14 comprises the rearwardmost surface 44 of the fuse carrier 14 having a blind bore 60 and a plunger 62. The plunger 62 of the plunger assembly 58 of the fuse carrier 14 is disposed in the blind bore 60 in the rearwardmost surface 44 of the fuse carrier 14, is biased outwardly therefrom by a spring 64, and enters the blind bore 33 in the one plate 32 of the base 12 when the fuse carrier 14 is in an on position.

The fuse carrier 14 further has a stop assembly 65. The stop assembly 65 of the fuse carrier 14 comprises the uppermost surface 47 of the fuse carrier 14 having a blind slot 66 extending therealong and a pawl 68. The pawl 68 of the stop assembly 65 of the fuse carrier 14 is slidably mounted in the blind slot 66 in the uppermost surface 47 of the fuse carrier 14 and selectively cooperates with the plunger assembly 34 of the base 12.

Figure 8:
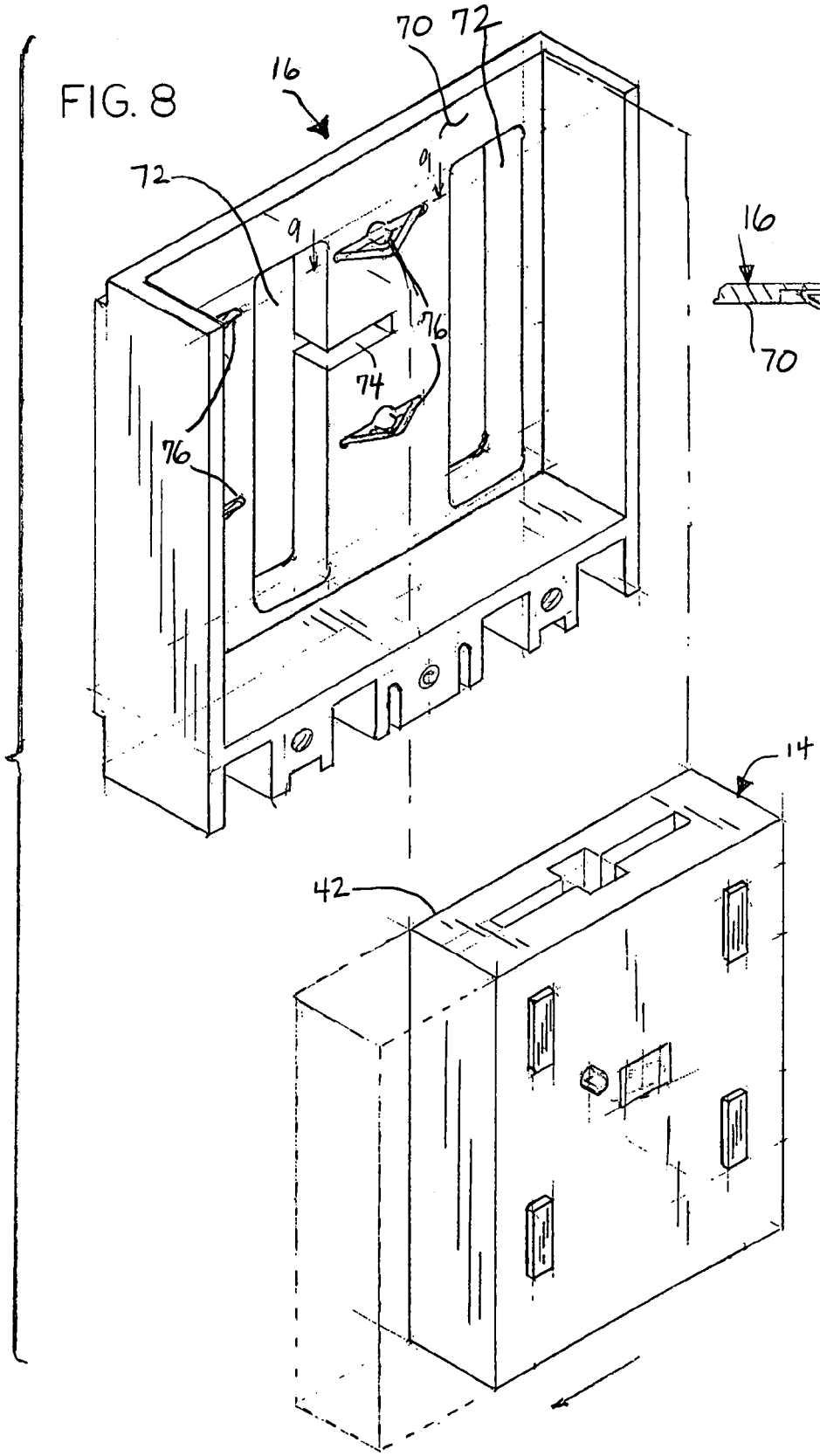
FIG. 8 is a diagrammatic rear perspective view of the cover of the present invention identified by ARROW 8 in FIGS. 1-3.
Figure 9:
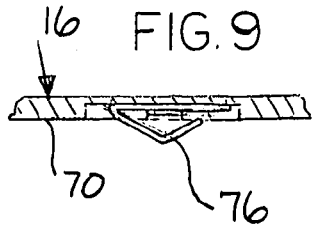
FIG. 9 is a diagrammatic cross sectional view taken along LINE 9-9 in FIG. 8.

The configuration of the cover 16 can best be seen in FIGS. 8 and 9, and as such, will be discussed with reference thereto.

The cover 16 has a rearwardmost surface 70. The cover 16 captures the fuse carrier 14 between itself and the base 12, with the rearwardmost surface 70 of the cover 16 abutting the forwardmost surface 42 of the fuse carrier 14 as the fuse carrier 14 selectively slides sidewardly relative to the base 12 and the cover 16.

The cover 16 further has a pair of through slots 72. The pair of through slots 72 in the cover 16 align with the pair of recesses 48 in the forwardmost surface 42 of the fuse carrier 14 when the fuse carrier 14 is in an off position for allowing access to the fuses (not shown), and do not align with, so as to allow the cover 15 to conceal, the pair of recesses 48 in the forwardmost surface 42 of the fuse carrier 14 when the fuse carrier 14 is in an on position for preventing contact with electrical components by a user.

The cover 16 further has a secondary through slot 74. The secondary through slot 74 in the cover 16 extends sidewardly from one of the through slots 72 in the cover 16, and has the handle 54 of the fuse carrier 14 extend therethrough and move therealong as the fuse carrier 14 traverses the on an off positions thereof.

The cover 16 further has two pair of spring contacts 76. The two pair of spring contacts 76 of the cover 16 are disposed on the rearwardmost surface 70 of the cover 16. Each pair of the two pair of spring contacts 76 of the cover 16 align with an associated one of the pair of recesses 48 in the forwardmost surface 42 of the fuse carrier 14 when the fuse carrier is in the on position for applying a force to and maintain the fuses (not shown) in the pair of recesses 48 in the forwardmost surface 42 of the fuse carrier 14.

It will be understood that each of the elements described above, or two or more together, may also find a useful application in other types of constructions differing from the types described above.

While the invention has been illustrated and described as embodied in a fusible electric slide switch, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A fusible electric slide switch, comprising:

a) a base;

b) a fuse carrier; and c) a cover;

wherein said fuse carrier is slidably mounted to said base;

wherein said cover maintains said fuse carrier slidably mounted to said base;

wherein said base has a back portion;

wherein said base has a top portion;

wherein said back portion of said base has an uppermost edge;

wherein said back portion of said base has a forwardmost surface;

wherein said back portion of said base has a lowermost edge; wherein said top portion of said base has a lowermost surface; and wherein said top portion of said base extends forwardly from said uppermost edge of said back portion of said base so as to be generally inverted L-shaped in lateral cross section;

wherein said base has a plurality of electrical terminals;

wherein said plurality of electrical terminals of said base are disposed on said forwardmost surface of said back portion of said base;

wherein said plurality of electrical terminals of said base are disposed adjacent said lowermost edge of said back portion of said base;

wherein said base has a plurality of electrical lands;

wherein said plurality of electrical lands of said base have a plurality of electrodes, respectively;

wherein said plurality of electrical lands of said base are disposed on said forwardmost surface of said back portion of said base; and wherein said plurality of electrical lands of said base electrically communicate with said plurality of electrical terminals of said base, respectively.

2. The switch as defined in claim 1, wherein said base has a pair of plates;

wherein said pair of plates of said base are disposed on said forwardmost surface of said back portion of said base;

wherein said pair of plates of said base cover said plurality of electrical lands of said base, except for said plurality of electrodes of said plurality of electrical lands of said base; and wherein one plate of said base has a blind bore.

3. The switch as defined in claim 2, wherein said base has a plunger assembly;

wherein said plunger assembly of said base comprises said lowermost surface of said top portion of said base having a blind bore;

wherein said plunger assembly of said base comprises a plunger;

wherein said plunger of said plunger assembly of said fuse carrier is disposed in said blind bore in said lowermost surface of said top portion of said base; and wherein said plunger of said plunger assembly of said fuse carrier is biased outwardly from said blind bore in said lowermost surface of said top portion of said base by a spring.

4. The switch as defined in claim 3, wherein said fuse carrier has a forwardmost surface;

wherein said fuse carrier has a rearwardmost surface;

wherein said fuse carrier has a pair of sidewardmost surfaces; and wherein said fuse carrier has an uppermost surface.

5. The switch as defined in claim 4, wherein said rearwardmost surface of said fuse carrier abuts against said pair of plates of said base and said uppermost surface of said fuse holder abuts against said lowermost surface of said top portion of said base as said fuse carrier selectively slides sidewardly relative to said base.

6. The switch as defined in claim 4, wherein said forwardmost surface of said fuse carrier has a pair of recesses; and wherein said pair of recesses in said forwardmost surface of said fuse carrier are for holding a pair of fuses, respectively.

7. The switch as defined in claim 6, wherein said pair of recesses in said forwardmost surface of said fuse carrier are disposed adjacent said pair of sidewardmost surfaces of said fuse carrier, respectively.

8. The switch as defined in claim 6, wherein said fuse carrier has two pair of electrodes; and wherein said two pair of electrodes of said fuse carrier have tails.

9. The switch as defined in claim 8, wherein each pair of electrodes of said fuse carrier are disposed in an associated recess in said forwardmost surface of said fuse carrier;

wherein each pair of electrodes of said fuse carrier are for electrically communicating with an associated fuse;

wherein said tails of said two pair of electrodes of said fuse carrier extend through said rearwardmost surface of said fuse carrier; and wherein said tails of said two pair of electrodes of said fuse carrier selectively electrically communicate with said plurality of electrodes of said base as said fuse carrier slides sidewardly relative to said base.

10. The switch as defined in claim 8, wherein said fuse carrier has a pair of jumper electrodes; and wherein said pair of jumper electrodes of said fuse carrier electrically connect associated ones of each pair of said two pair of electrodes of said fuse carrier with each other.

11. The switch as defined in claim 6, wherein said fuse carrier has a handle;

wherein said handle extends generally centrally through said fuse carrier;

wherein said handle extends from said forwardmost surface of said fuse carrier to said rearwardmost surface of said fuse carrier; and wherein said handle of said fuse carrier moves with said fuse carrier.

12. The switch as defined in claim 11, wherein said cover has a pair of through slots;

wherein said pair of through slots in said cover align with said pair of recesses in said forwardmost surface of said fuse carrier when said fuse carrier is in an off position for allowing access to the fuses; and wherein said pair of through slots in said cover do not align with, so as to allow said cover to conceal, said pair of recesses in said forwardmost surface of said fuse carrier when said fuse carrier is in an on position for preventing contact with electrical components by a user.

13. The switch as defined in claim 12, wherein said cover has a secondary through slot;

wherein said secondary through slot in said cover extends sidewardly from one of said through slots in said cover;

wherein said handle of said fuse carrier extend through said secondary through slot in said cover; and wherein said handle of said fuse carrier moves along said secondary through slot in said cover as said fuse carrier traverses on and off positions thereof.

14. The switch as defined in claim 6, wherein said cover has a rearwardmost surface;

wherein said cover captures said fuse carrier between itself and said base; and wherein said rearwardmost surface of said cover abuts said forwardmost surface of said fuse carrier as said fuse carrier selectively slides sidewardly relative to said base and said cover.

15. The switch as defined in claim 14, wherein said cover has two pair of spring contacts; and wherein said two pair of spring contacts of said cover are disposed on said rearwardmost surface of said cover.

16. The switch as defined in claim 15, wherein each pair of said two pair of spring contacts of said cover align with an associated one of said pair of recesses in said forwardmost surface of said fuse carrier when said fuse carrier is in on position for applying a force to and maintain fuses in said pair of recesses in said forwardmost surface of said fuse carrier.

17. The switch as defined in claim 4, wherein said fuse carrier has a plunger assembly;

wherein said plunger assembly of said fuse carrier comprises said rearwardmost surface of said fuse carrier having a blind bore;

wherein said plunger assembly of said fuse carrier comprises a plunger;

wherein said plunger of said fuse carrier is disposed in said blind bore in said rearwardmost surface of said fuse carrier;

wherein said plunger of said fuse carrier is biased outwardly from said blind bore in said rearwardmost surface of said fuse carrier by a spring; and wherein said plunger of said plunger assembly of said fuse carrier enters said blind bore in said one plate of said base when said fuse carrier is in an on position.

18. The switch as defined in claim 4, wherein said fuse carrier has a stop assembly;

wherein said stop assembly of said fuse carrier comprises said uppermost surface of said fuse carrier having a blind slot extending therealong;

wherein said stop assembly of said fuse carrier comprises a pawl;

wherein said pawl of said stop assembly of said fuse carrier is slidably mounted in said blind slot in said uppermost surface of said fuse carrier; and wherein said pawl of said stop assembly of said fuse carrier selectively cooperates with said plunger assembly of said base.

* * * * *